US007837810B2

(12) United States Patent
Messer et al.

(10) Patent No.: US 7,837,810 B2
(45) Date of Patent: Nov. 23, 2010

(54) POST WELD HEAT TREATMENT FOR CHEMICALLY STABILIZED AUSTENITIC STAINLESS STEEL

(75) Inventors: Barry Messer, Calgary (CA); Terrell T. Phillips, Houston, TX (US); Vasile Oprea, Calgary (CA)

(73) Assignee: Fluor Technologies Corporation, Aliso Viejo, CA (US)

( * ) Notice: Subject to any disclaimer, the term of this patent is extended or adjusted under 35 U.S.C. 154(b) by 882 days.

(21) Appl. No.: 10/570,780

(22) PCT Filed: Jun. 16, 2004

(86) PCT No.: PCT/US2004/019949

§ 371 (c)(1),
(2), (4) Date: Apr. 17, 2007

(87) PCT Pub. No.: WO2005/024071

PCT Pub. Date: Mar. 17, 2005

(65) Prior Publication Data

US 2009/0020191 A1 Jan. 22, 2009

Related U.S. Application Data

(60) Provisional application No. 60/500,113, filed on Sep. 3, 2003.

(51) Int. Cl.
*C21D 9/50* (2006.01)

(52) U.S. Cl. ..... 148/529; 148/218

(58) Field of Classification Search ..... 148/529, 148/218

See application file for complete search history.

(56) References Cited

U.S. PATENT DOCUMENTS

| | | | | |
|---|---|---|---|---|
| 4,418,258 A | | 11/1983 | McNealy et al. | 219/643 |
| 4,814,236 A | * | 3/1989 | Qureshi et al. | 428/678 |
| 6,127,643 A | | 10/2000 | Unde | 219/73 |

FOREIGN PATENT DOCUMENTS

JP 55069218 A * 5/1980

* cited by examiner

*Primary Examiner*—George Wyszomierski
*Assistant Examiner*—Weiping Zhu
(74) *Attorney, Agent, or Firm*—Fish & Associates, PC

(57) ABSTRACT

Thermo-mechanical properties of welds in stainless steel is substantially improved by the implementation of a post weld heat treatment that illiminates sigma phase in the heat treated zone and favors niobium carbonitride precipitate formation in a desirable size range. In most cases, post weld heat treated material can be employed in pressurized devices at temperatures exceeding 550° C., which is currently regarded the upper safe temperature limit, and material according to the inventive subject matter was tested at temperature of up to 850° C. without reheat cracking.

14 Claims, 6 Drawing Sheets

POST WELD HEAT TREATMENT FOR CHEMICALLY STABILIZED AUSTENITIC STAINLESS STEEL

This application claims the benefit of U.S. provisional patent application with the Ser. No. 60/500,113, which was filed Sep. 3, 2003, and which is incorporated by reference herein.

FIELD OF THE INVENTION

Compositions and methods for stainless steel, and especially as it relates to high-temperature use and post weld heat treatment of stainless steel.

BACKGROUND OF THE INVENTION

Stainless steel typically requires a stabilization treatment where such material is used at operating temperatures above 900° F. (482° C.). In many cases, the stabilization treatment includes a 1650° F. (899° C.) heating step after fabrication. However, at operating temperatures above 900° F. (482° C.), stabilization treatment tends to compromise the high temperature service weld and heat affected zone (HAZ) integrity through sigma phase embrittlement. Moreover, and especially at relatively high temperatures, stabilization treatment also reduces impact properties, elevated temperature creep properties, and/or increases susceptibility to reheat cracking.

There are various mitigation techniques known in the art to overcome at least some of the problems associated with stabilization treatment. However, current experience seems to indicate that susceptibility to cracking cannot be entirely eliminated. For example, use of 347 type stainless steels in high temperature operating environments is generally limited by reheat cracking during post weld heat treatment (PWHT) and/or stress relaxation cracking after long-term elevated temperature service.

Commonly, known heat treatments include thermal stress-relief to reduce residual stresses, solution-annealing to dissolve carbides, ferrite and sigma, and heat stabilization to form carbon adducts (e.g., chromium carbide precipitates) with alloy components.

Stress Relief: Optimal time and temperature for stress relief are reported between 1550° F. and 1650° F. (843° C. and 899° C.) for about 2 hours. Commonly, stress relief PWHT is performed on TP 347 stainless steel piping between 1550° F. and 1650° F. (843° C. and 899° C.) to reduce residual stresses from cold working and/or joint restraints, and to further reduce the susceptibility to chloride stress corrosion cracking.

Solution Annealing: In most cases, solution annealing relieves all or almost all of the welding related residual stresses, dissolves chromium carbides, converts delta ferrite to austenite in equilibrium phase-fractions, and/or spheroidizes the remaining ferrite, thus imparting corrosion resistance comparable to the base metal. It is generally recommended to perform solution annealing relatively quickly (e.g., less than 60 minutes) to minimize oxidation and surface chromium depletion. Depending on the alloy, solution annealing is generally performed at 1900° F. to 2000° F. (1038° C. to 1093° C.) in most cases.

Stabilization Heat Treatment: Stabilization heat treatment is thought to dissolve nearly all remaining chromium carbides ($Cr_{23}C_6$) that segregated at the grain boundaries from previous heat treatments or thermal operations (e.g., welding). Stabilization heat treatment is also thought to provide stress relief and is sometimes referred to as stabilization anneal. In most known applications, stabilization is performed by heating at 1650° F. (899° C.) for up to 4 hours followed by air cooling to ambient temperature to minimize sensitization.

Unfortunately, the stabilization heat treatment can also lead to substantial degradation of mechanical and corrosion properties because of complex physical-chemical interactions. For example, currently practiced stabilization heat treatment at 1650° F. (899° C.) frequently maximizes the rate of fine niobium carbide formation and allows for sigmatization of most remaining ferrite, often leading to substantial loss of ductility and elevated-temperature creep strength. Therefore, to prevent failure during high temperature service, heat treated stainless steel use is generally limited to uses with operating temperatures below 950° F. (510° C.) to ensure immunity to sensitization.

In further known processes, additional heat treatments may be included as described in U.S. Pat. No. 4,418,258 to McNealy et al. to improve structural integrity. McNealy's heat treatments significantly improve resistance to cracking and corrosion, however, are generally limited to low-alloy materials (i.e., materials with less than 5% alloying metals). In other known methods, as described in U.S. Pat. No. 6,127,643 to Unde, certain welding processes are employed to control the cooling process of a weld. While Unde's welding process tends to reduce at least some of the problems associated with numerous cooling gradients in a weld (e.g., crystalline inhomogeneity, etc.), various problems nevertheless remain. Among other things, Unde's process will in many cases provide only limited use for stainless steel.

Therefore, while rapid progress in elevated temperature petrochemical technology has created a demand for use of stainless steels beyond the traditional operating limits of 950° F. (510° C.), existing heat treatments typically fails to eliminate problems associated with loss of ductility, creep strength, and/or cracking. Thus, there is still a need to provide improved methods and compositions for stainless steel.

SUMMARY OF THE INVENTION

The present invention is directed to improved methods and compositions for austenitic stainless steel, and particularly as they relate to post weld heat treatment of such materials. In especially preferred aspects, contemplated treatments of such materials with welds will result in substantially improved thermo-mechanical properties and allows use of stainless steel at high temperatures well above current practice (e.g., above 800° C. instead of below 510° C.).

In one aspect of the inventive subject matter, a method of treating austenitic stainless steel having a weld includes one step in which the weld is subjected to a stress relief temperature that is below a temperature in which a metal carbonitride is formed. In another step, the weld is subjected to a solution anneal temperature that is effective to dissolve delta ferrite and that is below a temperature in which grain growth occurs, and in still another step, the weld is subjected to a stabilization anneal temperature that is effective to avoid sigmatization and to promote formation of niobium carbonitride precipitates having a size between 300 Å to 600 Å.

Most preferably, the weld is heated to the stress relief temperature (e.g., between 590° C. and 600° C. for at least 120 minutes) using a temperature gradient of between 14° C. to 25° C. per minute, and subsequently heated from the stress relief temperature to the solution anneal temperature (e.g., between 1038° C. and 1066° C. for at least 120 minutes) using a temperature gradient of between 18° C. to 30° C. per minute. After solution annealing, a relatively slow cooling step (e.g., between 1.5° C. to 3° C. per minute) is performed to reach the stabilization anneal temperature (e.g., between 945° C. to 965° C.), which is typically held for at least 60 minutes.

In another aspect of the inventive subject matter, a method of treating austenitic stainless steel having a weld includes one step in which the weld is heated to a stress relief temperature of between 510° C. and 648° C. using a ramp-up rate of at least 14° C. per minute. In another step, the weld is heated to a solution anneal temperature of between 1010° C. and 1177° C. using a ramp-up rate of at least 18° C. per minute, and in yet another step, the weld is cooled to a stabilization anneal temperature of at least 930° C. using a ramp-down rate of less than 3° C. per minute.

In particularly preferred aspects of such methods, the stress relief temperature, the solution anneal temperature, and/or the stabilization anneal temperature are maintained for a period sufficient to impart reheat cracking resistance at a temperature of no less than 650° C., more typically at least 750° C., and most typically at least 850° C. Furthermore, it is generally preferred that the solution anneal temperature and the stabilization anneal temperature are maintained for a period sufficient to substantially completely prevent sigmatization in the treated austenitic stainless steel. Alternatively, or additionally, it is contemplated that the stabilization anneal temperature is maintained for a period sufficient to promote formation of niobium carbonitride precipitates having a size between 300 Å to 600 Å.

Consequently, in a still further aspect of the inventive subject matter, a post weld heat treated austenitic stainless steel material (e.g., 347H stainless steel, 347LN stainless steel, or 16Cr11Ni2.5MoNb stainless steel) comprising a weld that is substantially free of a sigma phase and further has niobium carbonitride precipitates with a size between 300 Å to 600 Å, and wherein the weld has an increased toughness compared to before a toughness before the heat treatment as determined by an impact notch test.

Various objects, features, aspects and advantages of the present invention will become more apparent from the following detailed description of preferred embodiments of the invention.

DETAILED DESCRIPTION

The inventors discovered that a multi-step PWHT will significantly extend the use of austenitic stainless steel in high temperature environments and will allow in at least some of the materials use at temperatures of 850° C. and even higher. Materials manufactured using contemplated methods will retain desirable thermo-mechanical and corrosion resistance properties while providing high immunity to sigma phase embrittlement, reheat and stress relief cracking.

Particularly preferred PWHT include a stress relief step, a solution anneal step, and a stabilizing stress relief step that provide an optimized microstructure of the weld and heat affected zone (HAZ), thereby substantially improving resistance to elevated temperature cracking. Furthermore, the inventors discovered that using contemplated methods, commonly encountered limitations associated with classical stabilization heat treatments (e.g., sigma phase embrittlement, low ductility properties, etc.) are eliminated.

Figure 1:
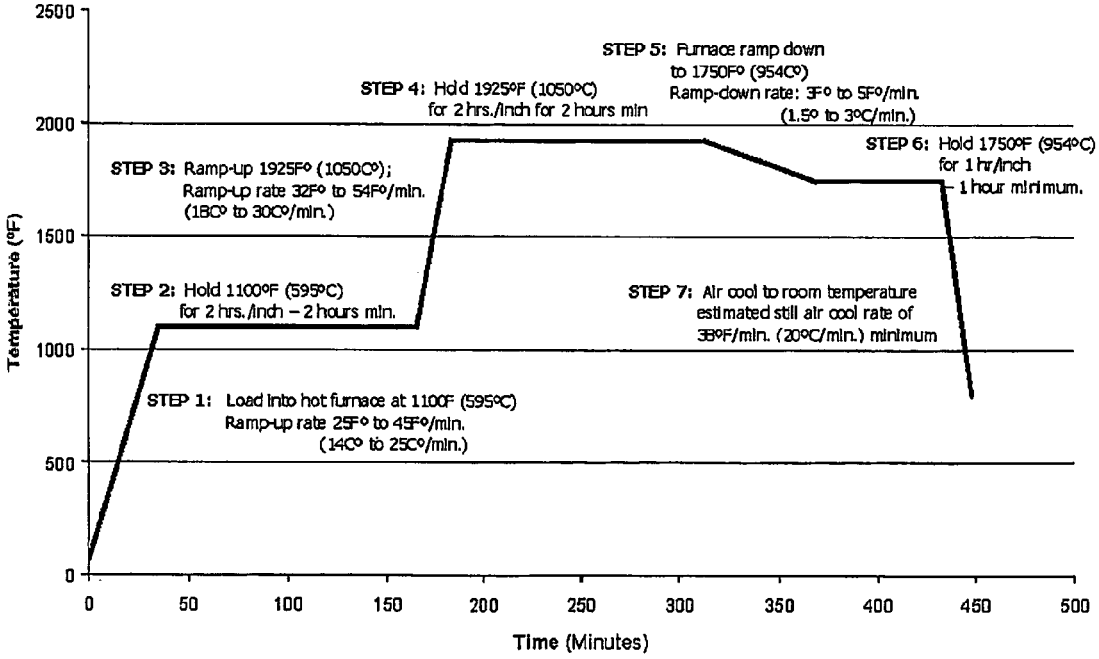
FIG. 1 is a graph depicting a temperature profile of an exemplary improved post weld heat treatment.
Figure 2A:
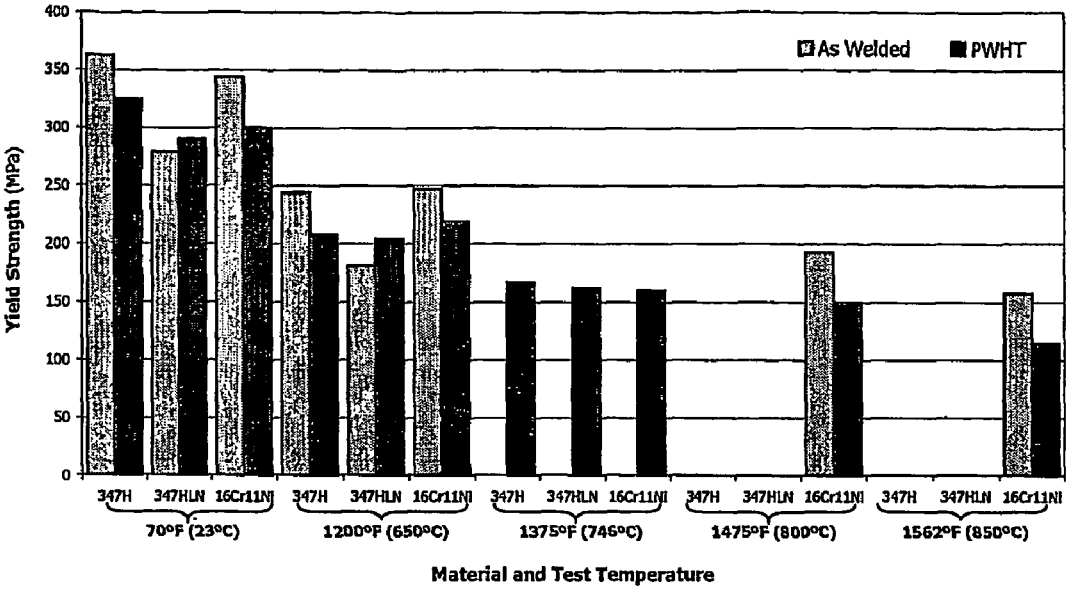
FIG. 2A is a graph depicting the yield strengths of three exemplary stainless steel samples (type 347H, 347HLN, and 16Cr11Ni2.5MoNb) at increasing temperatures.
Figure 2B:
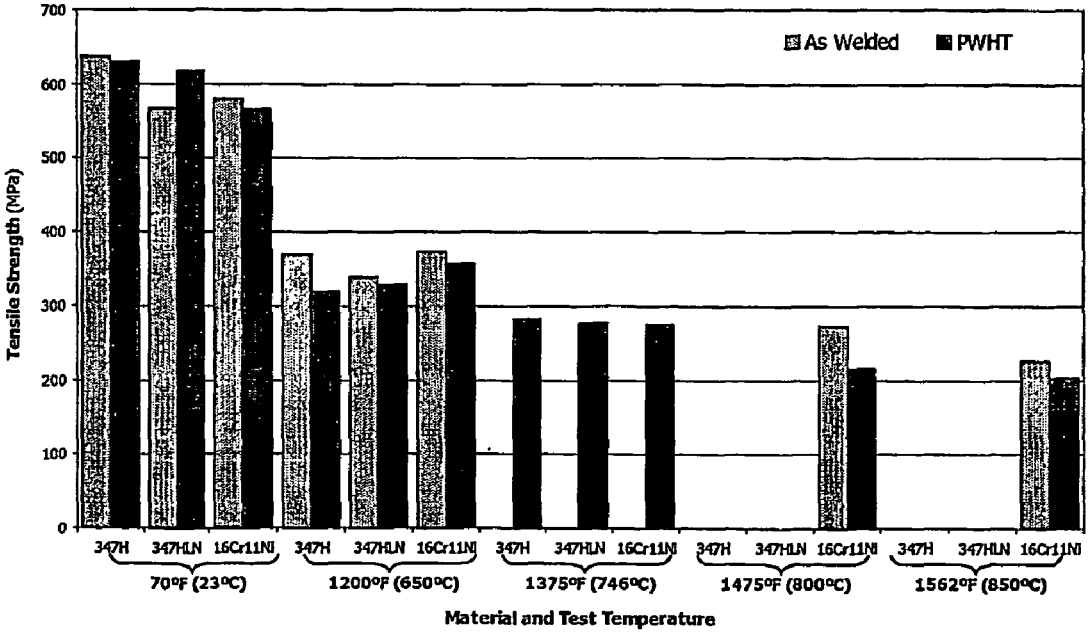
FIG. 2B is a graph depicting the tensile strengths of three exemplary stainless steel samples (type 347H, 347HLN, and 16Cr11Ni2.5MoNb) at increasing temperatures.
Figure 2C:
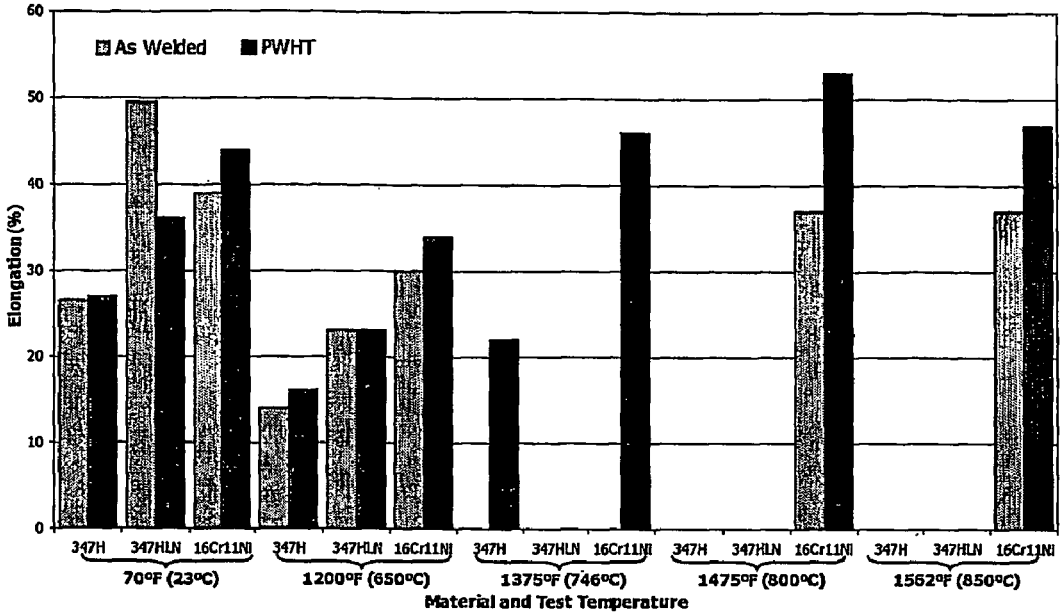
FIG. 2C is a graph depicting the elongations of three exemplary stainless steel samples (type 347H, 347HLN, and 16Cr11Ni2.5MoNb) at increasing temperatures.
Figure 2D:
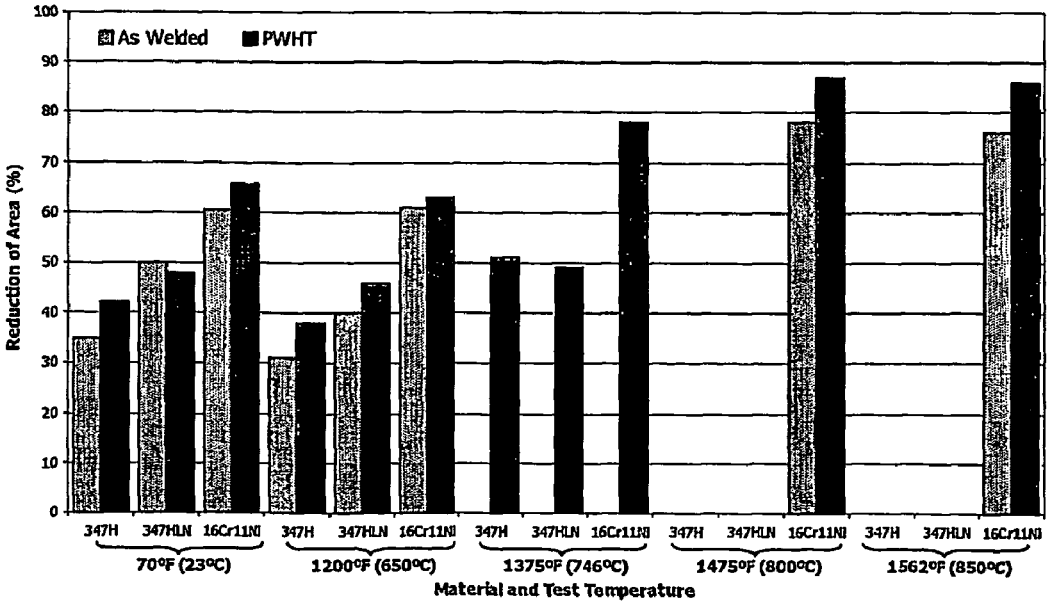
FIG. 2D is a graph depicting the reductions of area of three exemplary stainless steel samples (type 347H, 347HLN, and 16Cr11Ni2.5MoNb) at increasing temperatures.

An exemplary PWHT temperature profile for a 347H stainless steel sample with a weld depicted in FIG. 1. Here, the sample is loaded into a hot furnace preheated to a temperature of about 1100° F. (593° C.). The ramp-up rate for the sample is between about 25° F. to 45° F. (14° C. to 25° C.) per minute. Once the stress relief temperature is reached, the sample is held at 1100° F. (593° C.) for 2 hours per inch (2 hours minimum). After the stress relief step is completed, the sample is further heated to the solution anneal temperature of about 1925° F. (1052° C.) using a ramp-up rate of about 32° F. to 54° F. (18° C. to 30° C.) per minute. The sample is then held at 1925° F. (1052° C.) for 2 hours per inch (2 hours minimum) and subsequently cooled to a stabilization anneal temperature of about 1750° F. (954° C.) using a ramp-down rate of 3° F. to 5° F. per minute (15° C.-3° C. per minute). The stabilization anneal temperature is maintained for about for 1 hour per inch, with a 1 hour minimum. In a final step, the sample is cooled down to room temperature using air cool down at a ramp-down rate of about 27° F. to 45° F. (15° C. to 25° C.) per minute. As used herein, the term "about" in conjunction with a numeral refers to a value that is +/−10% (inclusive) of that numeral.

With respect to suitable ramp-up speeds to the stress relief temperature, it is preferred that the heat rate is relatively fast to prevent reheat cracking while the material is heated through a temperature range where the materials has decreased ductility. Based on various observations, the inventors contemplate that reheat cracking during heat-treating may be accentuated by slow ramp-up rates. Therefore, it is generally preferred that the ramp-up rate according to the methods of the present inventive subject matter is at least 10° F./minute, more preferably at least 20° F./minute, and most preferably between 25 F.° and 45 F.° (14 C.° to 25 C.°) per minute, and even higher. At least some of these ramp-up rates can be achieved using an atmospheric furnace, but may also achieved using an induction heater.

Depending on the particular material, it should be appreciated that the stress relief temperature may vary considerably. However, it is typically preferred that the stress relief temperature is below a temperature at which a metal carbonitride is formed, but sufficient to relieve at least some of the stress. It should be appreciated that otherwise undesirable Cr23C6 and/or sigma phase may be allowed to form during the stress relief as any such material will dissolve during the subsequent solution anneal. Consequently, for most 347 stainless steel materials, the preferred stress relief temperature is between about 900° F. and 1150° F., and most preferably between about 1050° F. and 1150° F. The inventors observed that the optimum temperature for stress relief in 347 materials is at about 1100° F. (593° C.). It should be noted that lower stress relief temperatures are also deemed suitable, however, the time required for a desired stress relief is typically significantly longer as the temperature decreases. Thus, in most embodiments, the selected holding time during the stress relief was at 1100° F. (593° C.) for 2 hours per inch, with a 120 minute minimum. However, longer stress relief durations are also contemplated (but generally not preferred). On the other hand, and especially where the temperature for stress relief is lower, longer stress relief heat durations are also deemed appropriate (e.g., 2-3 hours, 3-5 hours, and even longer).

In further contemplated aspects, it is preferred that the stress relief step is immediately followed by a temperature ramp-up to the solution anneal temperature. Particularly preferred ramp-up steps to the solution anneal step are relatively fast and will typically be at least 15° F. per minute, more typically at least 25° F. per minute, and most typically between about 32° F. to 54° F. (18° C. to 30° C.) per minute. Among other things, it is contemplated that a relatively fast ramp-up temperature from the stress relief to the solution anneal temperature will help reduce, or even eliminate, formation of appreciable quantities of Cr23C6 and sigma phase, which are known to at least partially contribute to cracking. Thus, all ramp up rates from the stress relief temperature to the solution anneal temperature that reduce or eliminate formation of Cr23C6 and/or sigma phase are particularly preferred.

With respect to contemplated solution anneal temperatures, it is preferred that suitable temperatures are selected such that the temperature is high enough to substantially completely (at least 95%, more preferably at least 98%) dissolve delta ferrite, which in many cases will lead to sigma phase formation and undissolved metal carbides (e.g., M23C6). However, as the solution anneal temperature increases, large niobium carbonitride complexes tend to dissolve. The niobium then re-precipitates as the temperature decreases and frequently causes a drop in ductility (this phenomenon was demonstrated by Irvine et al with solution annealing temperatures of 1922° F. to 2372° F. (1050° C. to 1300° C.)). Therefore, suitable solution anneal temperatures are typically limited to temperatures below 1200° C.

Suitable solution anneal temperatures are also low enough to prevent grain growth and/or loss of niobium to the dissolved metal. Grain growth during heat treatment can affect the creep properties of stainless steels. Advani et al found that 316 stainless steels experience hardly any grain growth at 1832° F. (1000° C.), but excessive growth at 2012° F. (1100° C.). Stabilized stainless steels can withstand higher temperatures without grain growth due to pinning by the precipitates. This is shown by Padilha et al in 321 type stainless steel, where no grain growth occurred below 1922° F. (1050° C.). From 1922° F. to 2282° F. (1050° C. to 1250° C.), secondary re-crystallization occurred. At temperatures higher than 2282° F. (1250° C.), normal grain growth occurred. Mill testing indicated that TP347 type stainless steels will form an ASTM grain size of 4 or finer below 1950° F. (1066° C.) solution anneal. A coarse ASTM grain size 2 to 3 will form after 2 hours at 2000° F. (1093° C.).

Therefore, particularly preferred solution annealing will be performed at relatively low temperatures, and most preferably at a temperature of about 1925° F. (1052° C.). For example, most 347 stainless steel will be solution annealed at a temperature of between about 1900° F. to about 1950° F. (1038° C. to 1066° C.). However, it should be recognized that in alternative aspects, solution annealing can also be performed in a wider range of temperatures between about 1850° F. to about 2150° F. (1010° C. to 1177° C.). Similarly, it is preferred that the solution anneal temperature is at least 120 minutes. However, where oxidation is of particular concern (or for other reasons), the duration of the solution anneal step may be between 60 minutes and 120 minutes, and even less. On the other hand, and particularly where relatively high degree of sigma phase is expected, longer durations (e.g., between 2 to 4 hours, and even longer) are also appropriate.

Once the solution anneal is completed or otherwise ended, the temperature is ramped down to the stabilization anneal temperature. While not critical to the inventive subject matter it is generally preferred that the ramp-down is relatively slow to better accommodate to and/or even avoid thermal stresses. Thus, where an air furnace is employed, particularly suitable methods include slow air cooling, most preferably at a temperature gradient of less than 10 F per minute, and more preferably of less than 5 F per minute (e.g., between about 3 F.° to 5 F.° (1.5 C.° to 3 C.°) per minute).

The inventors surprisingly discovered that the stabilization anneal step is preferably performed at a relatively high temperature (at least 1700° F.) for various reasons. Among other things, temperatures higher than 1700 F will often lead to significantly reduced sigmatization, stress relief, and tend to increase formation of coarse precipitate size between about 300-600 Å. For most stainless steel materials, the inventors noted that sigmatization occurs at temperatures up to 1700° F. (927° C.), but rarely above. Consequently, in various aspects of the inventive subject matter, 1750° F. (954° C.) was selected as stabilization anneal temperature to ensure that the welds are sigma-free. In other aspects, the stabilization anneal temperature was held for a period of at least 60 minutes between 945° C. to 965° C. However, alternative stabilization anneal durations include those between 20 and 60 minutes, and between 60 minutes and 4 hours, and even longer.

Furthermore, the inventors observed that stabilization stress relief at about 1750° F. (954° C.) more efficiently eliminated residual stresses, and produced coarse grains in the range of 300-600 Å, than lower temperature stabilization would produce. Niobium carbonitride precipitates are typically in the range of 150-200 Å when stabilization anneal is performed at the commonly used temperature of 1650° F. (899° C.). Larger precipitates, and especially those in a size range of about 300-600 Å are thought to reduce ductility significantly less than smaller precipitates as dislocations will loop around the smaller precipitates. Viewed from another perspective, it is generally contemplated that increased dislocation movement allows accommodation of creep by the interior of the grains, thereby reducing reheat cracking. Such contemplations are supported by Irvine et al reporting improved ductilities in samples aged at temperatures higher than 1742° F. (950° C.). After stabilization anneal, the inventors observed that carbon was almost completely tied up in form of a metal carbonitride, and levels of delta ferrite and/or chromium carbide were not detectable.

The improved thermo-mechanical properties achieved by the present methods, and especially using high temperature stabilization anneal, are particularly surprising for various reasons. For example, Irvine et al observed a drop in tensile strength after aging at 1742° F. (950° C.). In other observations (Bolinger et al.), heater tubes had poor sensitization resistance after an incorrect heat treatment, and it was concluded that the sensitization was due to large niobium carbonitride particles that could be seen in a micrograph at 400× magnification.

In a further step of contemplated methods, the sample is cooled to room temperature using a relatively slow cool-down rate. In most methods, still air-cooling is sufficiently slow with a cool-down rate of less than 50° F. per minute, and more typically of less than 40° F. per minute. However, numerous alternative cooling profiles are also deemed suitable, so long as the cooling rate allows accommodation of thermal stresses to avoid material distortion. Thus, fast-quench cooling is generally less preferred.

Therefore, the inventors contemplate a method of treating austenitic stainless steel having a weld in which the weld is subjected to a stress relief temperature that is below a temperature in which a metal carbonitride is formed. In another step, the weld is subjected to a solution anneal temperature that is effective to dissolve delta ferrite and that is below a temperature in which grain growth occurs, and in still another step, the weld is subjected to a stabilization anneal temperature that is effective to avoid sigmatization and to promote formation of niobium carbonitride precipitates having a size between 300 Å to 600 Å. Using such methods, it should be recognized that the so heat treated austenitic steel can be incorporated into an industrial equipment (e.g., petrochemical reactor, conduit, or tower), and that the equipment can be operated at a temperature of no less than 550° C.

Viewed from a different perspective, contemplated methods of treating austenitic stainless steel having a weld may include a step of heating the weld to a stress relief temperature of between 510° C. and 648° C. using a ramp-up rate of at least 14° C. per minute. In another step, the weld is heated to a solution anneal temperature of between 1010° C. and 1177° C. using a ramp-up rate of at least 18° C. per minute, and in yet another step, the weld is cooled to a stabilization anneal temperature of at least 930° C. using a ramp-down rate of less than 3° C. per minute.

Most preferably, the stress relief temperature, the solution anneal temperature, and/or the stabilization anneal temperature is maintained for a period sufficient to impart reheat cracking resistance at a temperature of no less than 650° C., more typically at least 750° C., and even more typically at least 850° C. Consequently, as such temperatures provide a significant improvement over existing temperature limits, it should be recognized that contemplated methods may be advertised in a method of marketing, and especially where austenitic steel is provided as a commercially available product.

With respect to the welding methods, it is generally contemplated that all known manners of welding stainless steel are deemed suitable. However, particularly preferred methods of weld formation include gas tungsten arc welding or shielded metal arc welding.

EXAMPLE

Materials

Unless stated otherwise, welding was performed as follows: Base metals used were austenitic stainless steel 347H, 347HLN, and 16Cr11Ni2.5MoNb. Welding processes were gas tungsten arc welding (GTAW; root with 347, 16Cr11Ni2.5MoNb, to match base) and shielded metal arc welding (SMAW; fill and cap with 347, 16Cr11Ni2.5MoNb, to match base).

In order to prevent liquation and sigmatization, consumable chemistry control of weld metal electrodes was employed. The control kept the amount of ferrite low resulting in low levels of conversion to sigma phase. The chemistry control provides for low impurities in electrode chemistry, which significantly reduces the probability of liquation and solidification cracking mechanisms. Samples of TP347H, TP347HLN, and 16Cr11Ni2.5MoNb were welded and post weld heat treated with the contemplated multi-step PWHT procedure as exemplarily shown in FIG. 1. Samples were also tested in the "as-welded" condition for comparison. Most tests were performed using a GLEEBLE thermo-mechanical simulator commercially available from DSI Inc.

Tests

The following test were performed using both "as welded" and post weld heat treated samples: (1) Room temperature impacts; (2) Room temperature and elevated temperature tensile, yield, strength, elongation and reduction of area tests; (3) ASTM A262 Practice A sensitization tests to address intergranular corrosion resistance for stainless steels susceptible to sensitization; (4) Thermal-mechanical accelerated stress relaxation test; (5) Macro and micro examination using 10% oxalic acid; (6) SEM/EDX determination of precipitate chemistry; (7) Tensile tests at room temperature and elevated temperature to determine changes in mechanical properties including yield strength, tensile strength, elongation and reduction of area; (8) Charpy "V" Notch Test at room temperature; (9) Thermal-Mechanical Test Simulation using a simulator to replicate forms of post weld heat treatment cracking and stress relaxation cracking that material would be subjected to in actual fabrication or end use following long-term elevated temperature service.

A thermal-mechanical stress relaxation test was chosen to evaluate the materials' susceptibilities to reheat cracks. This test used a real weld with the stress-raising notch in the HAZ. The samples were heated to 1200° F., (649° C.) 1375° F. (746° C.), 1472° F. (800° C.), and 1562° F. (850° C.) at 90° F. (50° C.) per minute, and a strain of 100% yield at the test temperature was applied. The sample extension was kept constant through the test while force was recorded for a test time of three hours.

Macro and Micro Examination. Macro and micro examinations were used for identification and confirmation of material defects. Scanning Electron Microscopy with Energy Dispersive X-ray Analysis (SEM EDX). The SEM/EDX technique uses accelerated beams of primary electrons with a multiple electrostatic and magnetic lenses. Intensity of deflected beams identifies defects, aids with identification of defects, and characterization of composition of identified defects. The EDX spectrometer used for analysis of precipitates is capable of analyzing only elements with atomic number 9 or greater. An analytical spot size of about 2 μm was used, and most precipitate analyses will necessarily include some base material.

Test Results

After examination of various samples after PWHT and using various test methods as described above, the inventors observed substantially increased resistance to elevated temperature cracking and an optimized microstructure. Furthermore, based on the inventors' observations, it appears that contemplated PWHT provides high immunity to fabrication and in-service cracking while retaining good mechanical and corrosion resistance properties.

FIGS. 2A-2D depict the yield strengths, tensile strengths, elongation, and reduction of area, respectively, of three exemplary stainless steel samples (type 347H, 347HLN, and 16Cr11Ni2.5MoNb) at increasing temperatures. Clearly, PWHT materials were comparable or superior to the corresponding "as welded" samples. Moreover, the 16Cr11Ni2.5MoNb exhibited superior performance after PWHT, even at temperatures of 850° C. (and even higher, data not shown).

The tensile data for "as-welded" and PWHT condition shows minor changes. The optimized PWHT did not substantially modify mechanical characteristics. Hot temperature testing was performed 1375° F. (746° C.), 1472° F. (800° C.), and 1562° F. (850° C.). The drop in tensile and yield values for PWHT samples were approximately 5-10% when compared with samples in the "as-welded" condition. Hot tensile at 1472° F. (800° C.), and 1562° F. (850° C.) were performed only on 16Cr11Ni2.5MoNb.

have a higher rate of carbide precipitation than the 1562° F. (850° C.) samples. This difference may help explain the increased sensitivity to reheat cracking at 1472° F. (800° C.) compared to 1562° F. (850° C.) found in this study and previously reported by Li and Messler. A temperature less than 1472° F. (800° C.) may represent the maximum practical operating exposure temperature for "as-welded" materials. Thermo-mechanical test simulation at 1375° F. (746° C.) was carried out on heat-treated samples only, and they showed no reheat cracking behavior.

While the 16Cr11Ni2.5MoNb 1472° F. (800° C.) "as-welded" samples contained HAZ reheat cracks, the 1472° F. (800° C.) and 1562° F. (850° C.) PWHT samples did not contain reheat cracks. These optimized PWHT samples demonstrate improved performance. A possible explanation for the improvement is that most of the niobium is precipitated during the heat treatment leaving little to precipitate later during testing. This niobium precipitation factor may also make heat treated materials resistant to high temperature creep embrittlement and stress relaxation cracking during prolonged service. The table below lists some of the results obtained.

| TEMPERATURE | | 16CR11NI2.5MONB | | 347H | | 347HLN | |
|---|---|---|---|---|---|---|---|
| (° F.) | (° C.) | "AW" | PWHT | "AW" | PWHT | "AW" | PWHT |
| 1375 | 746 | No Test | No Crack | No Test | No Crack | No Test | No Crack |
| 1472 | 800 | Crack, HAZ | No Crack | Crack, HAZ and Weld Metal | No Crack | Crack, HAZ, and Weld Metal | No Crack |
| 1562 | 850 | No Crack | No Crack | Crack, WM | No Crack | Crack, WM | No Crack |

Figure 3A:
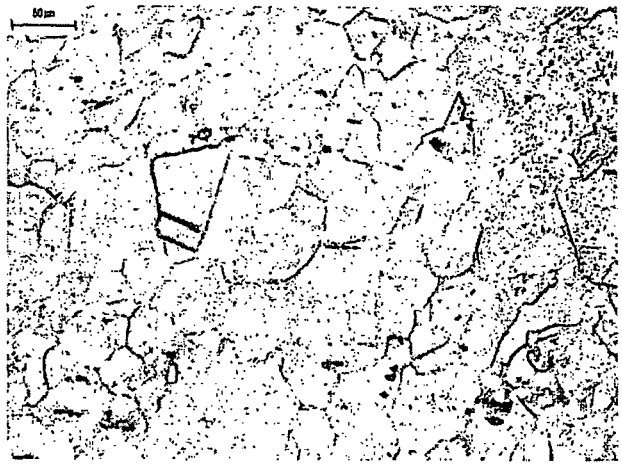
FIG. 3A is an electron micrograph depicting a 347H stainless steel sample after post weld heat treatment.
Figure 3B:
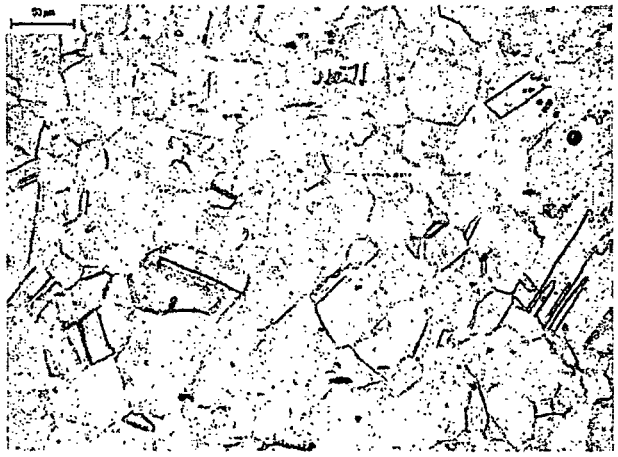
FIG. 3B is an electron micrograph depicting a 347HLN stainless steel sample after post weld heat treatment.
Figure 3C:
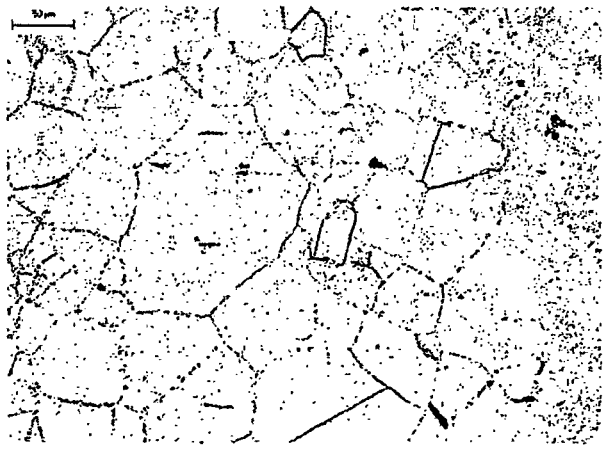
FIG. 3C is an electron micrograph depicting a 16Cr11Ni2.5MoNb stainless steel sample after post weld heat treatment.

FIGS. 3A-3C depict photomicrographs of 347H, 347HLN, and 16Cr11Ni2.5MoNb materials after PWHT. All treated samples passed the ASTM A262 Practice A sensitization screening tests. Evidently, contemplated PWHT has stabilize annealed the weld, the FAZ and base metal. Furthermore, no sigma phase was observed in any of the treated samples, indicating that all delta ferrite was dissolved in the solution anneal step.

Figure 4A:
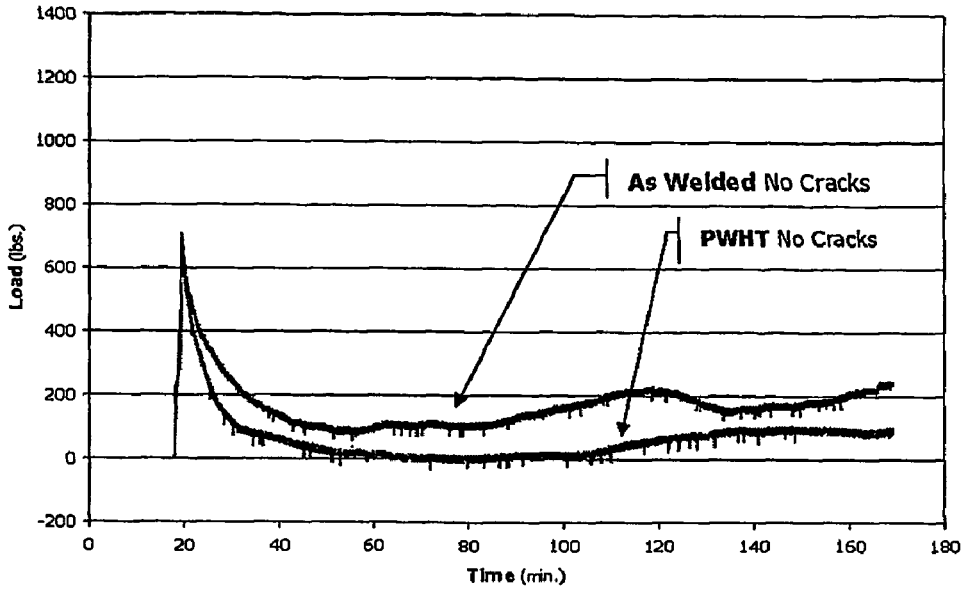
FIG. 4A is a graph depicting thermo-mechanical test results for a 347H stainless steel sample at a temperature of 850° C. and 100% yield strain.
Figure 4B:
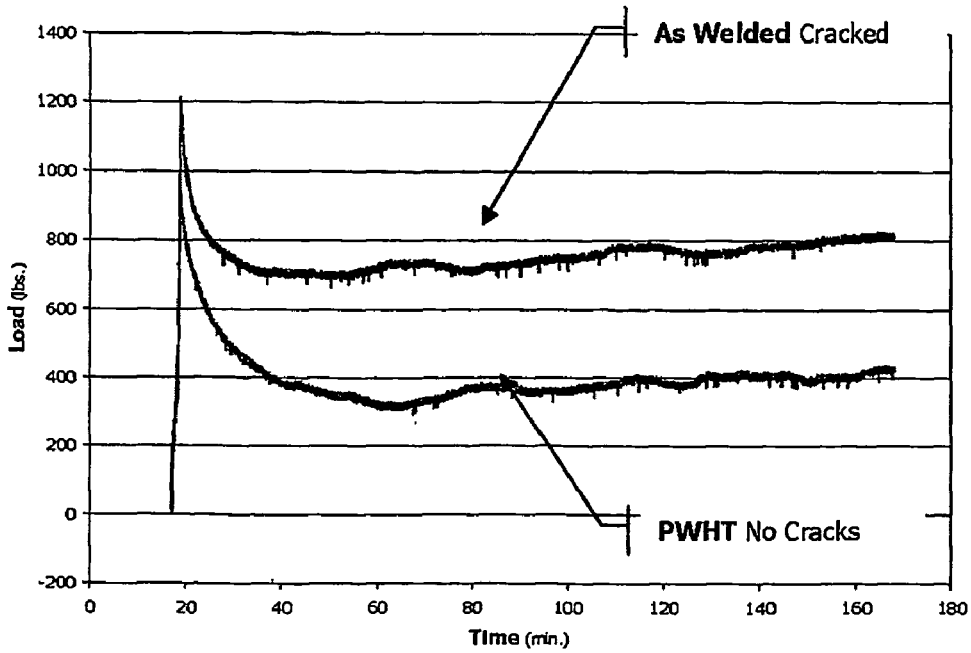
FIG. 4B is a graph depicting thermo-mechanical test results for a 347HLN stainless steel sample at a temperature of 800° C. and 100% yield strain.

FIGS. 4A-4B depict the results of thermo-mechanical stress simulation in which the samples were strained at 100% yield (Material used in FIG. 4A was 347H at 850° C. and 347HLN at 800° C. for FIG. 4B). As the stress curves at the tested stress level are not always indicative of cracking, further evaluation was performed using ultrasound. The effect of niobium carbide precipitation kinetics can be seen on the test sample curves. When these thermo-mechanical test simulation results were compared with photomicrographs of the samples tested at 1375° F. (746° C.), 1472° F. (800° C.), and 1562° F. (850° C.), it was noticed that only the 1472° F. (800° C.) samples in "as-welded" condition contained HAZ reheat cracks.

Figure 5A:
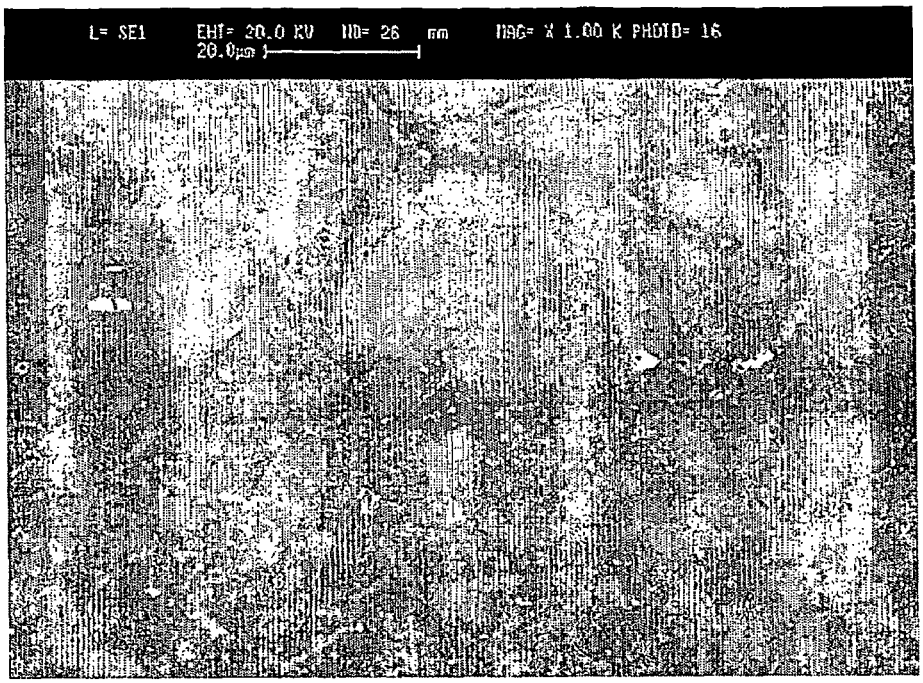
FIG. 5A is an electron micrograph depicting coarse Niobium precipitates in a 347H stainless steel sample after post weld heat treatment.
Figure 5B:
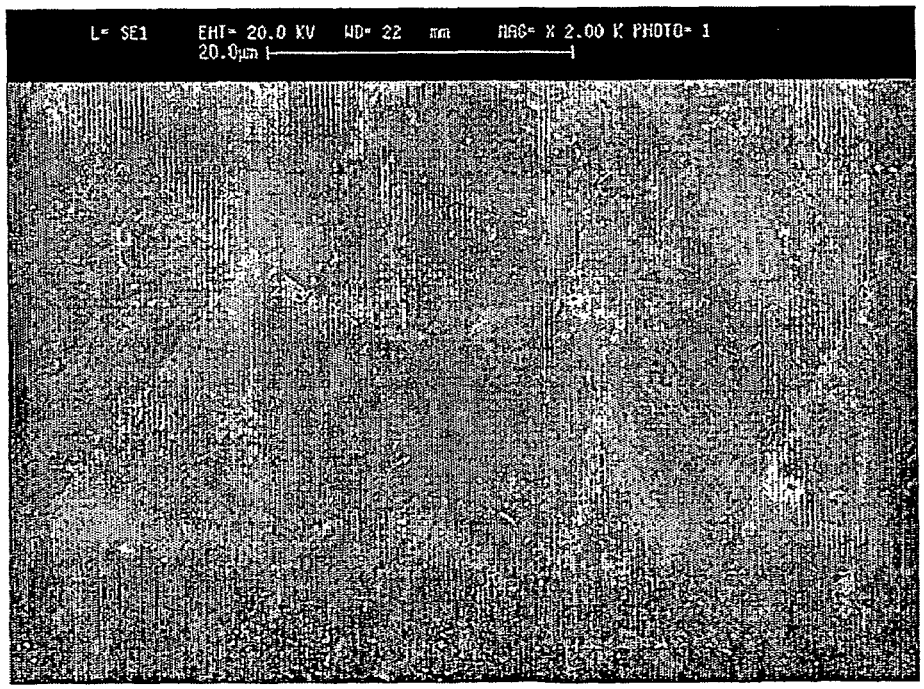
FIG. 5B is an electron micrograph depicting coarse and fine Niobium precipitates in a 347H stainless steel sample before post weld heat treatment.

When test sample curves were compared at the various temperatures, the time for load recovery tended to take 20 to 40 minutes longer for the heat-treated samples than for the "as-welded" samples. In addition, load recovery for the 1472° F. (800° C.) heat-treated samples was shorter than for the 1562° F. (850° C.) heat-treated samples. This load recovery time difference suggests that the 1472° F. (800° C.) samples FIG. 5A depicts coarse niobium precipitates at grain boundaries, while FIG. 5B shows coarse niobium precipitate at grain boundaries and fine niobium precipitates within the grains. SEM/EDX analysis of heat-treated samples (data not shown) shows the high levels of niobium precipitates in PWHT samples, while "as welded" samples showed lower levels of niobium precipitates. Based on SEM, SEM/EDX analysis, and thermo-mechanical test simulation results, the high levels of niobium precipitates in PWHT samples are of a coarse type, which may explain the cracking immunity on tested samples when optimized PWHT was applied. Fine niobium precipitates within grain boundaries are believed to be involved in both reheat and stress relaxation cracking failures. For stainless steels with improved creep resistance, such as TP 347H and 16Cr11Ni2.5MoNb, the susceptibility to these cracking mechanisms increase. Contemplated PWHT with controlled coarse Niobium carbonitride precipitates appear to significantly reduce, if not even eliminate the reheat-cracking phenomena.

Charpy "V" Notch Test ASTM A370. Charpy impact tests of deposited weld metal show a significant increase in toughness after heat treatment compared to the decrease previously reported in literature for a 1650° F. (899° C.) stabilize anneal. Charpy V Notch tests conducted at room temperature for "as-welded" and PWHT samples show a uniform improvement across weld, HAZ, and base metal. Room Temperature impact test results are listed in the table below in which all data are given in Joules:

| | "AS WELDED" | | | CONTEMPLATED PWHT | | |
|---|---|---|---|---|---|---|
| MATERIAL | Base Metal | HAZ | Weld | Base Metal | HAZ | Weld |
| 347H | 181.3 | 154.0 | 103.3 | 167.3 | 170.7 | 159.3 |
| 347HLN | 180.7 | 139.3 | 117.3 | 192.0 | 148.7 | 123.3 |
| 16Cr11Ni | 288.7 | 165.0 | 148.0 | 290.7 | 156.7 | 174.3 |

Nitrogen (N) Effect: Contemplated PWHT on 347H with the addition of N appears to improve the room temperature impact toughness of the weld metal. This improvement is not seen with the 347HLN samples. Weld metal ductility has been improved by the reduction of delta ferrite and the coarsening of niobium carbonitride precipitates. Here, it is contemplated that the carbonitride precipitate is considered the dominant ductility increasing effect.

Therefore, it should be appreciated that contemplated PWHT prevents reheat cracking to temperatures of 1562° F. (850° C.), and even higher. Furthermore, contemplated PWHT also prevents weld metal embrittlement while retaining excellent mechanical properties for 347H, 347HLN, and 16Cr11Ni2.5MoNb. Among other mechanisms, it is contemplated that PWHT prevents sigma phase embrittlement, and provides stress relief, and produces relatively coarse niobium carbonitride precipitates, thereby improving hot ductility and reducing (if not even entirely eliminating) reheat cracking.

It is especially noteworthy that contemplated methods produces fewer, but coarser, niobium carbonitride precipitates than previously known heat treatments at 1650° F. (899° C.) (possibly due to carbide precipitation kinetics), thus providing substantially greater immunity to reheat cracking. Additionally, such treatment provides significant carbon stabilization as demonstrated by the inventors' ASTM A262 testing.

A further benefit of contemplated PWHT includes substantially improved toughness as compared to published data for stabilization anneal heat treatments at 1650° F. (899° C.). Among other things, it is contemplated that such advantages may be in part due to (or maintained by) the relatively steep ramp-up and ramp-down rates to prevent formation of sigma phase and/or to control the precipitate morphology. Thus, materials obtained using contemplated PWHT repeatedly and consistently outperformed their "as welded" counterparts. For example, thermal-mechanical simulation tests showed a maximum reheat cracking temperature for "as-welded" samples at 1472° F. (800° C.) due to a peak in fine Nb(C,N) precipitation kinetics. In contrast, heat-treated samples were crack-free up to 1562° F. (850° C.), the highest temperature tested.

It should still further be recognized that contemplated PWHT also produce a micro structural morphology that reduces future precipitation caused by creep during long-term, high-temperature operation. As a consequence, contemplated heat treatments permit the use of 347 type alloys in the creep temperature range without reheat cracking.

Therefore, it should be recognized that contemplated materials include post weld heat treated austenitic stainless steel material comprising a weld that is substantially free of a sigma phase (less than 1 area % in a horizontal cross section, more typically less than 0.1 area %, and most typically less than 0.01 area %) and further has niobium carbonitride precipitates with a size between 300 Å to 600 Å, and wherein the weld has an increased toughness compared to before a toughness before the heat treatment as determined by an impact notch test. In most preferred aspects, the fraction of precipitates having a size of 300 Å to 600 Å is at least 20%, more typically at least 30%, and even more typically at least 50%.

Thus, specific embodiments and applications of improved methods and compositions for stainless steel have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method of treating austenitic stainless steel having a weld, comprising:

subjecting the weld to a stress relief temperature that is below a temperature in which a metal carbonitride is formed;

subjecting the weld to a solution anneal temperature that is effective to dissolve delta ferrite and that is below a temperature in which grain growth occurs; and subjecting the weld to a stabilization anneal temperature of at least 927° C. to thereby avoid stigmatization, and wherein the stabilization anneal temperature is selected to promote formation of niobium carbonitride precipitates having a size between 300 Å to 600 Å.

2. The method of claim 1 wherein the weld is heated to the stress relief temperature using a temperature gradient of between 14° C. to 25° C. per minute.

3. The method of claim 1 wherein the weld is subjected to the stress relief temperature for a period of at least 120 minutes, and wherein the stress relief temperature is between 590° C. and 600° C.

4. The method of claim 1 wherein the weld is heated from the stress relief temperature to the solution anneal temperature using a temperature gradient of between 18° C. to 30° C. per minute.

5. The method of claim 1 wherein the weld is subjected to the solution anneal temperature for a period of at least 120 minutes, and wherein the stress relief temperature is between 1038° C. and 1066° C.

6. The method of claim 1 wherein the weld is cooled from the solution anneal temperature to the stabilization anneal temperature using a temperature gradient of between 1.5° C. to 3° C. per minute.

7. The method of claim 1 wherein the weld is subjected to the stabilization anneal temperature for a period of at least 60 minutes, and wherein the stabilization anneal temperature is between 945° C. to 965° C.

8. The method of claim 1 further comprising a step of including the treated austenitic stainless steel in an equipment and operating the equipment at a temperature of no less than 550° C.

9. A method of treating austenitic stainless steel having a weld, comprising:

heating the weld to a stress relief temperature of between 510° C. and 648° C. using a ramp-up rate of at least 14° C. per minute;

heating the weld to a solution anneal temperature of between 1010° C. and 1177° C. using a ramp-up rate of at least 18° C. per minute; and cooling the weld to a stabilization anneal temperature of at least 930° C. using a ramp-down rate of less than 3° C. per minute, wherein the stabilization anneal temperature is selected such as to promote formation of niobium carbonitride precipitates having a size between 300 Å to 600 Å.

10. The method of claim 9 wherein at least one of the stress relief temperature, the solution anneal temperature, and the stabilization anneal temperature is maintained for a period sufficient to impart reheat cracking resistance at a temperature of no less than 650° C.

11. The method of claim 9 wherein at least one of the stress relief temperature, the solution anneal temperature, and the stabilization anneal temperature is maintained for a period sufficient to impart reheat cracking resistance at a temperature of no less than 750° C.

12. The method of claim 9 wherein at least one of the stress relief temperature, the solution anneal temperature, and the stabilization anneal temperature is maintained for a period sufficient to impart reheat cracking resistance at a temperature of no less than 850° C.

13. The method of claim 9 wherein the solution anneal temperature and the stabilization anneal temperature are maintained for a period sufficient to substantially completely prevent sigmatization in the treated austenitic stainless steel.

14. The method of claim 9 wherein the stabilization anneal temperature is maintained for a period sufficient to promote formation of niobium carbonitride precipitates having a size between 300 Å to 600 Å.

* * * * *